US010458654B2

(12) United States Patent
Le Pannerer et al.

(10) Patent No.: US 10,458,654 B2
(45) Date of Patent: Oct. 29, 2019

(54) COMBUSTION CHAMBER IN A TURBINE ENGINE

(71) Applicant: Snecma, Paris (FR)

(72) Inventors: Brice Le Pannerer, Moissy Cramayel (FR); Laurent Bernard Cameriano, Moissy Cramayel (FR); Pierre-François Simon Paul Pireyre, Moissy Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 422 days.

(21) Appl. No.: 15/104,835

(22) PCT Filed: Dec. 17, 2014

(86) PCT No.: PCT/FR2014/053401
§ 371 (c)(1),
(2) Date: Jun. 15, 2016

(87) PCT Pub. No.: WO2015/092284
PCT Pub. Date: Jun. 25, 2015

(65) Prior Publication Data

US 2018/0163965 A1 Jun. 14, 2018

(30) Foreign Application Priority Data

Dec. 20, 2013 (FR) ..... 13 63348

(51) Int. Cl.
*F23R 3/28* (2006.01)
*F23R 3/50* (2006.01)
(Continued)

(52) U.S. Cl.
CPC ..... *F23R 3/283* (2013.01); *F23R 3/002* (2013.01); *F23R 3/06* (2013.01); *F23R 3/50* (2013.01); *F23R 3/60* (2013.01); *F05D 2260/30* (2013.01); *F23R 2900/00005* (2013.01); *F23R 2900/00012* (2013.01)

(58) Field of Classification Search
CPC .. F23R 3/002; F23R 3/283; F23R 3/50; F23R 3/60; F23R 2900/00005; F23R 2900/00001; F23R 3/06; F23R 2900/00012; F05D 2260/30
See application file for complete search history.

(56) References Cited

U.S. PATENT DOCUMENTS 4,454,711 A * 6/1984 Ben-Porat ..... F23R 3/10 60/748
4,686,823 A * 8/1987 Coburn ..... F23R 3/283 60/740

(Continued)

*Primary Examiner* — Alain Chau
(74) *Attorney, Agent, or Firm* — Blank Rome LLP

(57) ABSTRACT

The invention relates to an annular combustion chamber in a turbine engine, comprising two coaxial walls of revolution, one an internal wall (12) and the other an external wall (14), between which emerge fuel injectors (19) each engaged in centring means (36) which are moveable in the radial direction in support means (38), the chamber also comprising means (50, 68) of axial retention in the upstream direction of the centring means. According to the invention, the means of axial retention in the upstream direction are removably fixed to at least one of the internal (12) or external (14) walls of revolution.

12 Claims, 3 Drawing Sheets

(51) Int. Cl.

| | |
|---|---|
| ***F23R 3/60*** | (2006.01) |
| ***F23R 3/00*** | (2006.01) |
| ***F23R 3/06*** | (2006.01) |

(56) References Cited

U.S. PATENT DOCUMENTS

| | | | | |
|---|---|---|---|---|
| 5,996,335 | A | 12/1999 | Ebel | |
| 6,412,272 | B1 | 7/2002 | Titterton, III et al. | |
| 7,062,920 | B2 * | 6/2006 | McMasters | F23R 3/10 60/748 |
| 7,121,095 | B2 * | 10/2006 | McMasters | F23R 3/10 60/746 |
| 7,628,019 | B2 * | 12/2009 | Tanner | F23C 5/02 239/399 |
| 7,673,457 | B2 * | 3/2010 | Bessagnet | F23R 3/283 60/752 |
| 7,757,495 | B2 * | 7/2010 | Bessagnet | F23R 3/10 60/752 |
| 7,765,809 | B2 * | 8/2010 | Brown | F23R 3/10 60/752 |
| 7,975,487 | B2 * | 7/2011 | Lockyer | F23R 3/002 60/740 |
| 8,701,417 | B2 * | 4/2014 | Nicholls | F23R 3/10 60/756 |
| 2007/0051110 | A1 | 3/2007 | Holland et al. | |
| 2008/0010997 | A1 * | 1/2008 | Bessagnet | F23R 3/283 60/805 |
| 2008/0092547 | A1 * | 4/2008 | Lockyer | F23R 3/002 60/757 |
| 2008/0282703 | A1 | 11/2008 | Morenko et al. | |
| 2009/0293487 | A1 * | 12/2009 | De Sousa | F23R 3/283 60/752 |
| 2012/0240595 | A1 * | 9/2012 | Gerendas | F23R 3/002 60/796 |
| 2012/0272652 | A1 * | 11/2012 | Nicholls | F23R 3/10 60/740 |
| 2013/0055722 | A1 | 3/2013 | Verhiel et al. | |
| 2013/0081270 | A1 * | 4/2013 | Patterson | F23R 3/002 29/888 |
| 2013/0247575 | A1 * | 9/2013 | Patel | F02C 7/24 60/752 |

* cited by examiner

COMBUSTION CHAMBER IN A TURBINE ENGINE

TECHNICAL FIELD

The present invention relates to an annular combustion chamber of a turbine engine as well as a turbine engine equipped with an annular combustion chamber.

BACKGROUND

According to a known technique, an annular combustion chamber comprises two coaxial internal and external walls of revolution connected together upstream by a so-called chamber bottom annular wall which comprises openings for the passage of fuel injector heads between the internal and external walls of revolution. Each injector is engaged in centring means which can move in the radial direction in support means integral with support means.

In the current technique, the centring means of each fuel injector is formed in a centring ring, wherein an injector is engaged, and comprising a radial annular collar which radially extends outwards and is mounted to slide in an annular groove of the support means.

The groove of the support means enables a radial displacement of the centring ring accommodating the injector so as to compensate for the manufacturing tolerances as well as the differential expansions in operation.

The annular groove for the radial displacement of the ring is defined by means of axial retention in the upstream direction and in the downstream direction of the radial annular collar of the centring means. In practice, the means of axial retention in the downstream direction consist of a downstream radial wall of an annular sheath fixed on the bottom of the annular chamber, with the radial wall being connected to a cylindrical rim which extends in the upstream direction and whereon a washer inserted on the cylindrical rim is welded or brazed.

Such washer is thus permanently fixed on the support means. When all or a part of the centring means of an injector must be replaced during a maintenance operation, this washer has to be broken, which is a delicate operation since the sheath which is fixed on the annular wall of the bottom of the chamber must not be damaged. Besides, weld beads breaking have been noted, which is not admissible, and does not ensure a perfect mechanical integrity of the fuel injection systems.

SUMMARY

The invention more particularly aims at providing a simple, efficient and cost-effective solution to the problems of the prior art disclosed above.

For this purpose, it provides for an annular combustion chamber in a turbine engine, comprising two coaxial internal and external walls of revolution, between which emerge fuel injectors each engaged in centring means which are moveable in the radial direction in support means, the chamber also comprising means of axial retention in the upstream direction of the centring means, with said means of axial retention, in the upstream direction being removably fixed on at least one of the internal and external walls of revolution, characterized in that the means of axial retention comprise a radial annular crown radially fixed internally and/or externally on at least one of the internal and external walls of revolution and comprising an annular row of openings for the passage of the injectors, with the edge of each opening being adapted to form an axial stop in the upstream direction of a radial annular collar of the centring means of the fuel injectors.

According to the invention, the means of axial retention in the upstream direction of the centring means are fixed on at least one of the internal and external walls of revolution and no longer on the support means, which enables a simple and quick mounting and dismounting of the means of axial retention for maintenance purposes.

The removable fastening may, for instance, be provided by bolts, using the fastening element used for making integral the bottom of an annular chamber and the internal and external walls of revolution, which can be easily implemented.

In this latter case, the length of the screws for fixing the bolting elements only has to be slightly increased to execute the fixing.

According to another characteristic, the annular crown advantageously comprises a plurality of rings regularly spaced apart circumferentially and delineating said holes for the passage of the injectors.

In such particular embodiment, the crown thus comprises free spaces between the rings, which avoids any significant increase in the mass of the means of axial retention in the upstream direction of the centring means.

According to still another advantageous characteristic, at least some of the crown rings are connected to at least one lug which radially extends inwards or outwards, the end opposite the ring of which is connected to a rim which axially extends, preferably in the downstream direction, and is used for fixing purposes on the internal and external walls of revolution, respectively.

Advantageously, the crown comprises a unitary pattern the successive repeating of which, on the circumference, forms the annular crown.

In a first alternative solution, the pattern comprises a ring connected to two radial internal and external lugs, with the radial internal lug being internally connected to an internal rim which extends in the downstream direction and is fixed to the internal wall of revolution and the radial external lug being externally connected to an external rim which extends in the downstream direction and is fixed to the external wall of revolution.

In a second alternative solution, the pattern comprises at least three rings the circumferential end rings of the pattern of which are connected to at least one radial lug, the end opposite the ring of which is provided with a rim extending in the downstream direction and fixed on the internal or external wall of revolution, with the rings circumferentially inserted between the two circumferential end rings of the pattern being connected to said circumferential end rings by circumferential arms.

Preferably, the circumferential end rings of the pattern are connected to two radial internal and external lugs, with the radial internal lug being internally connected to an internal rim which extends in the downstream direction and is fixed to the internal wall of revolution and the radial external lug being externally connected to an external rim which extends in the downstream direction and is fixed to the external wall of revolution.

The annular crown may be a single-piece part or comprise a plurality of crown portions which are circumferentially juxtaposed Using several crown portions may make it possible to exchange only one crown portion instead of the whole crown during maintenance operations, although this requires several independent mounting operations.

According to another advantageous characteristic, the support means comprise means of axial retention in the downstream direction of the centring means, with said support means being fixed on the bottom of an annular chamber.

According to still another advantageous characteristic, the means of axial retention in the upstream direction are fixed on said internal and external wall(s) of revolution using the same means for fastening said internal and external walls of revolution to a bottom of an annular chamber, which makes it possible to use pre-existing fixing areas and avoids any modification of the internal and external walls of revolution.

The fastening means are for instance bolts, which provide a stronger connection of the means of axial retention in the upstream direction than welds, as in the prior art.

The invention also relates to a turbine engine, such as a turbojet or a turboprop, comprising a combustion chamber as described above.

The invention also relates to axial retention element of a centring part of an injector in a combustion chamber, comprising a radial annular crown which:

- must be internally and/or externally fixed on at least one of the internal or external walls of revolution of an annular combustion chamber of a turbine engine, and
- comprises an annular row of openings for the passage of fuel injectors, with the edge of each opening being adapted to form an axial stop in the upstream direction of a radial annular collar of the centring means of one of the fuel injectors, and a plurality of rings regularly spaced apart circumferentially and at least some of which are provided with two lugs which extend diametrally opposite one another from the ring, with the two lugs each comprising a rim which extends along the axis of the ring and preferably in the same direction.

BRIEF DESCRIPTION OF THE DRAWINGS

The invention will be better understood, and other details, characteristics and advantages of the invention will appear upon reading the following description given by way of a non restrictive example while referring to the appended drawings wherein.

DETAILED DESCRIPTION

Figure 1:
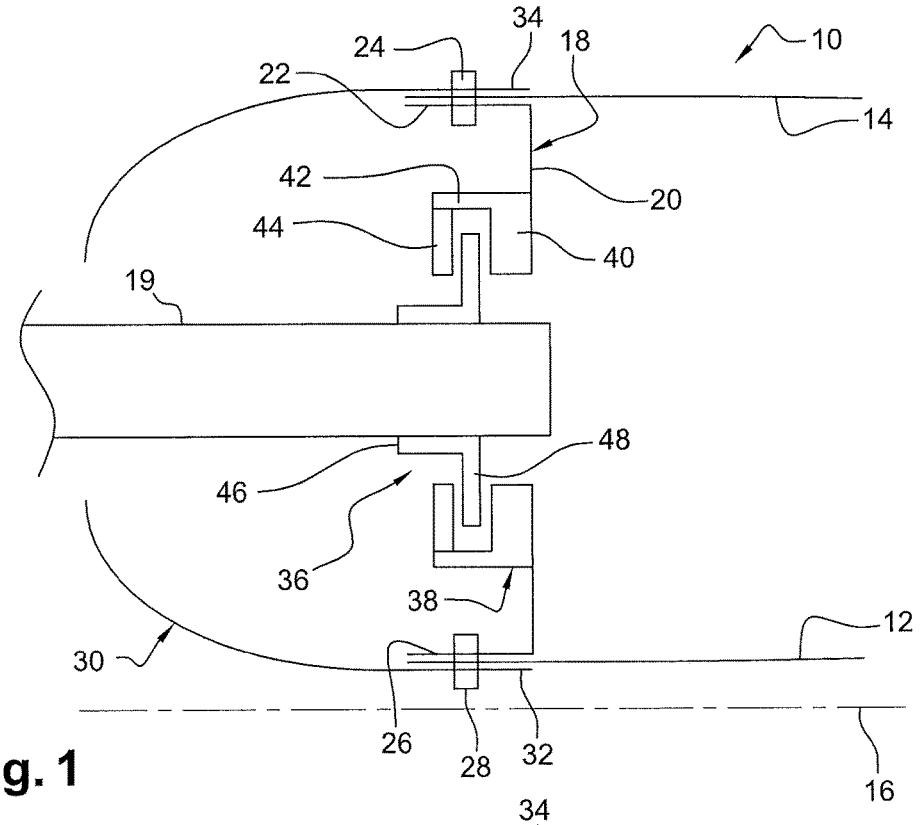
FIG. 1 is a schematic view, in axial cross-section, of the upstream portion of a combustion chamber according to the prior art.

Reference is first made to FIG. 1 which shows the upstream part of a combustion chamber 10 in a turbine engine according to the known technique comprising two internal 12 and external 14 walls of revolution which extend about the axis 16 of the combustion chamber and fixed at the upstream ends thereof to the bottom of an annular chamber 18 extending between the internal 12 and external 14 walls of revolution and traversed by fuel injectors 19. The bottom of the annular chamber 18 comprises a radial annular wall 20 the external periphery of which is connected to an external cylindrical rim 22 which extends in the upstream direction and is fixed by bolting elements 24 on the upstream end of the external 14 wall of revolution. The radial wall 20 of the bottom of the annular chamber 18 has an internal periphery connected to an internal cylindrical rim 26 which extends in the upstream direction and is fixed by bolting elements 28 on the upstream end of the internal 12 wall of revolution.

An annular faring 30 with a concave curved shape in the downstream direction in a section plane containing the axis 16 of the combustion chamber 10, is also traversed by the fuel injectors 19 and the radially internal 32 and external 34 downstream ends thereof are bolted on the internal 26 and external 22 cylindrical rims of the bottom of the chamber 18 and on the upstream ends of the internal 12 and external 14 walls of revolution. The upstream end of the external 14 wall of revolution is radially arranged between the external downstream end 34 of the faring 30 and the external cylindrical rim 22 of the bottom of the annular chamber 18. The upstream end of the internal 12 wall of revolution is radially arranged between the internal downstream end 32 of the faring 30 and the internal cylindrical rim 26 of the bottom of the annular chamber 18.

The bottom of the annular chamber 18 comprises a plurality of openings for the passage of injector heads 19 for spraying fuel between the internal 12 and external 14 walls of revolution and downstream of the bottom of the chamber 18.

Each injector 19 is axially engaged into centring means 36 of the injector 19, which centring means 36 can freely be moved in the radial direction in support means 38 integral with the bottom of the annular chamber 18.

The support means 38 of each injector 19 comprise an annular radial wall 40 fixed on the internal perimeter and oriented upstream of the opening for the passage of one injector 19. The radial annular wall 40 also comprises a cylindrical rim 42 which extends in the upstream direction.

In the prior technique (FIG. 1), for each injection system, a sheet 44 or a washer is fixed by welding or brazing the external periphery thereof onto the upstream end of the cylindrical rim 42 of the sheath.

The centring means of each injector 19 comprise a cylindrical ring 46 axially traversed by the head and comprising an annular collar 48 which radially extends outwards and mounted to radially slide in the groove delimited upstream, by the washer 44, downstream by the radial annular wall 40. The bottom of the groove is defined by the cylindrical rim 42.

As explained above, the weld beads of the washers 44 holding the centring means in the upstream direction may be weakened and are thus liable to break in operation, which affects the injection of fuel between the internal 12 and external 14 walls of revolution.

The invention makes it possible to remedy this problem by removably fixing the means of axial retention on at least one of the internal 12 and external 14 walls of revolution so as to facilitate the dismounting of the removable fixing means.

Figure 2:
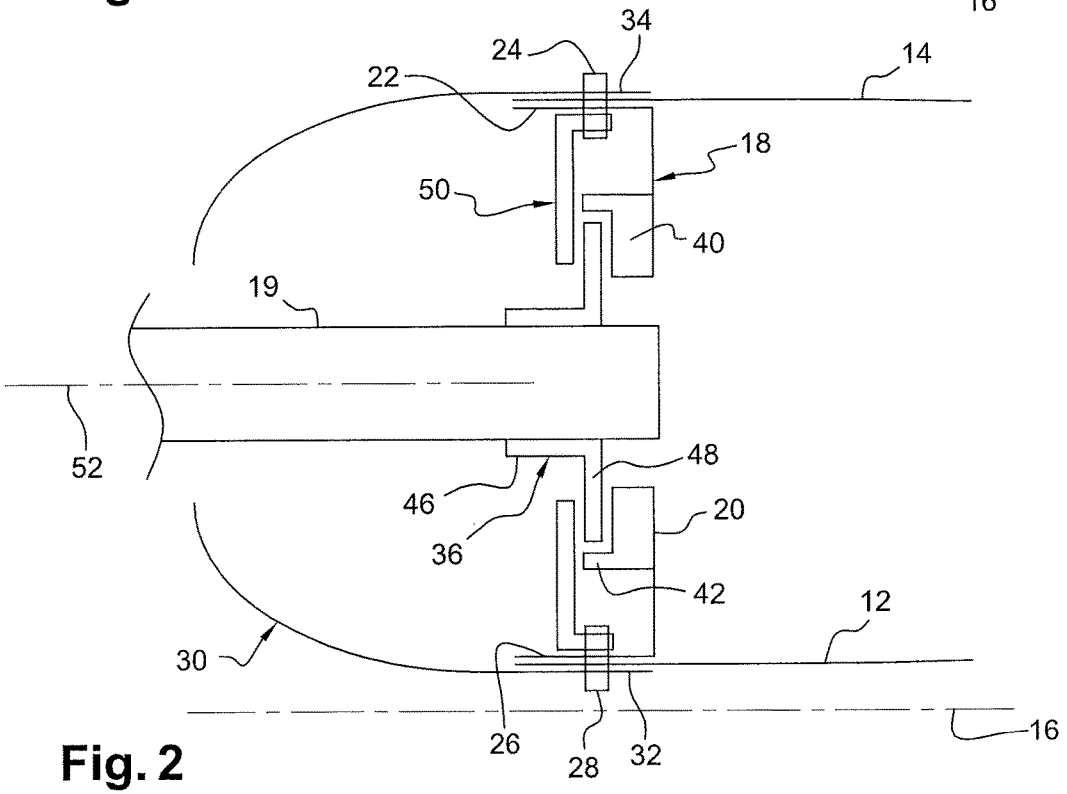
FIG. 2 is a schematic view, in axial cross-section, of the upstream portion of a combustion chamber according to the invention.

In the configuration of the invention shown in FIG. 2, the means of axial retention comprise an annular crown 50 the internal periphery of which is fixed on the internal 12 wall of revolution and the external periphery of which is fixed on the external 14 wall of revolution.

Figure 3:
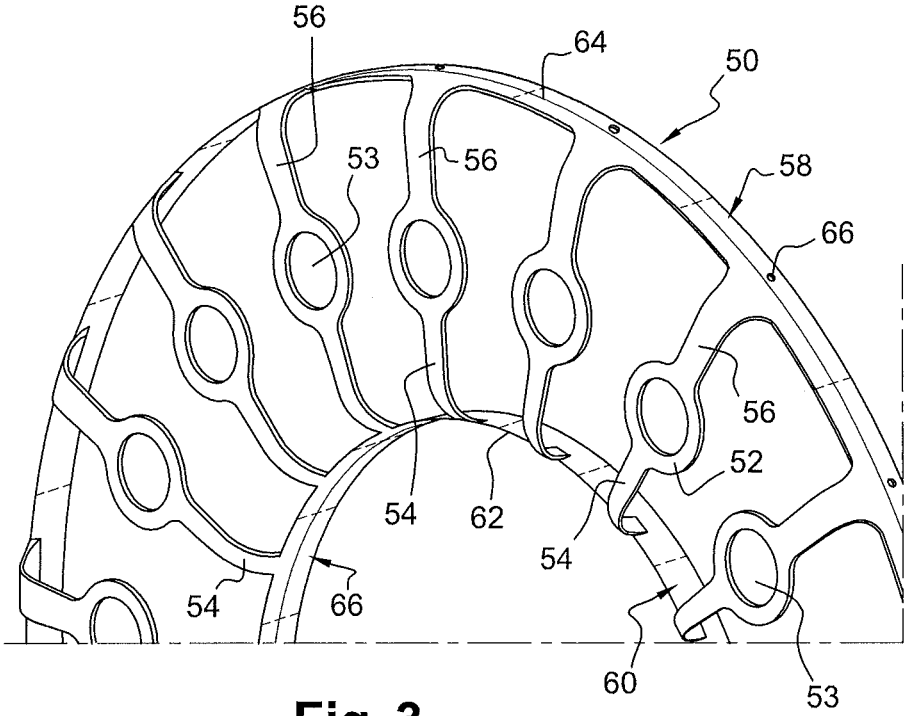
FIG. 3 is a schematic view, in perspective, of the means of axial retention in the upstream direction of the centring means of an injector according to a first embodiment of the invention.
Figure 4:
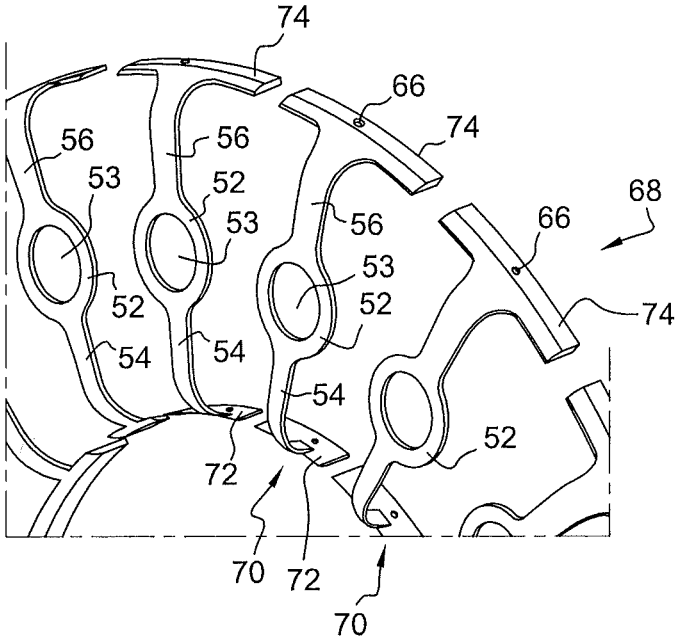
FIG. 4 is a schematic view, in perspective, of the means of axial retention in the upstream direction of the centring means of an injector according to a second embodiment of the invention.

As shown in FIG. 3, the crown 50 may be a single-piece part comprising a plurality of rings 52 which each consist of a radial annular wall forming an opening for the passage 53 of an injector 19 intended to be axially opposite an annular collar 48 of a centring ring 36 of an injector 19, so as to form an axial stop in the upstream direction of said annular collar 48.

Each ring 52 is connected to two lugs one 54 of which radially extends inwards and the other one 56 radially extends outwards. The radially external ends of the external lugs 56 are connected to an external cylindrical rim 58 which axially extends in the downstream direction. The radially internal ends of the internal lugs 54 are connected to an internal cylindrical rim 60 which axially extends in the downstream direction.

In this embodiment, the annular crown 50 thus consists of a plurality of unitary patterns successively repeated in the circumferential direction and integral with one another. Each pattern then consists of a ring 52, two radial internal 54 and external 56 lugs and portions of internal 62 and external 64 cylindrical rims.

Each internal 60 and external 58 cylindrical rim comprises holes 66 for the passage of a fixing screw, with such holes 66 being regularly distributed about the axis 16 of the combustion chamber. Each pattern thus comprises two holes 66, the centres of which are aligned with the centre of the ring 50 and located in the same radial plane containing the axis 16 of the combustion chamber. The external cylindrical rim 58 of the crown 50 is thus positioned next to the external cylindrical rim 22 of the bottom of the chamber 18 and is fixed to the external 14 wall of revolution using fixing screws 24. Similarly, the internal cylindrical rim 60 of the crown 50 is thus positioned next to the internal cylindrical rim 26 of the bottom of the chamber 18 and is fixed to the internal 12 wall of revolution using fixing screws 28.

The mounting and dismounting of the crown 50 can thus be easily and simply executed when maintenance is required. Besides, the double internal and external fixing of the crown 50 on the internal 12 and external 14 walls of revolution provides the crown with a good mechanical strength and ensures the integrity thereof in operation.

In a second embodiment of a crown 68 according to the invention, the latter consists in a plurality of independent patterns 70 juxtaposed on the circumference to form the annular crown 68. Each portion of internal 72 or external 74 cylindrical rim of a pattern has circumferential ends which are arranged with some clearance opposite the circumferential ends of the portions of the internal 72 or external 74 cylindrical rim, respectively, of adjacent patterns.

Figure 5:
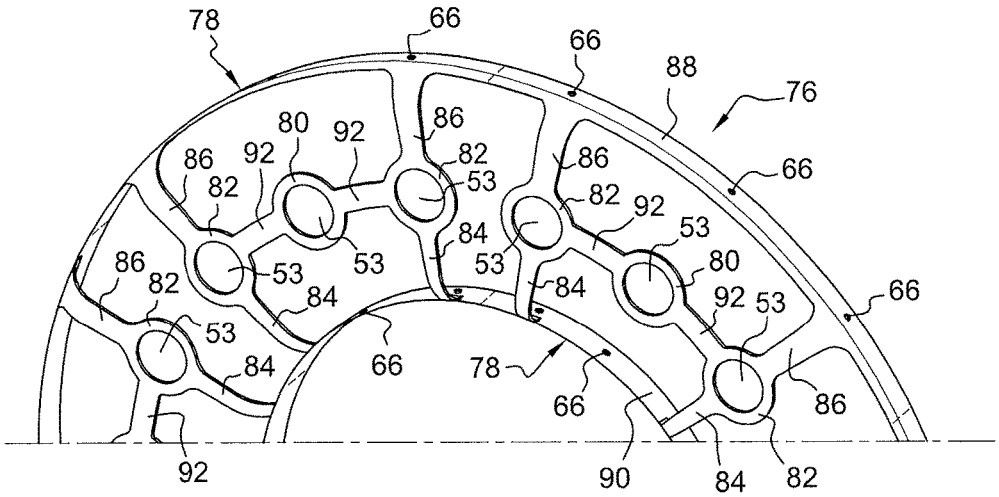
FIG. 5 is a schematic view, in perspective, of the means of axial retention in the upstream direction of the centring means of an injector according to a third embodiment of the invention.

FIG. 5 shows a third embodiment of an annular crown 76 according to the invention, which consists of the circumferential repeating of several H-shaped patterns 78 made integral and comprising, each, three successive rings 80, 82. Each pattern 78 thus comprises two circumferential end rings 82, with each one being connected to two lugs which radially extend inwards 84 and outwards 86. The external radial lugs 86 of the circumferential end rings 82 of each pattern 78 are connected to an external cylindrical rim 88 which extends in the downward direction and the internal radial lugs 84 of the circumferential end rings 82 of each pattern 78 are connected to an internal cylindrical rim 90 which extends in the downward direction. The ring 80 of each pattern 78 which is circumferentially inserted between two circumferential end rings 82 has no radial lug and is connected to the circumferential end rings 82 by circumferential junction arms 92.

Figure 6:
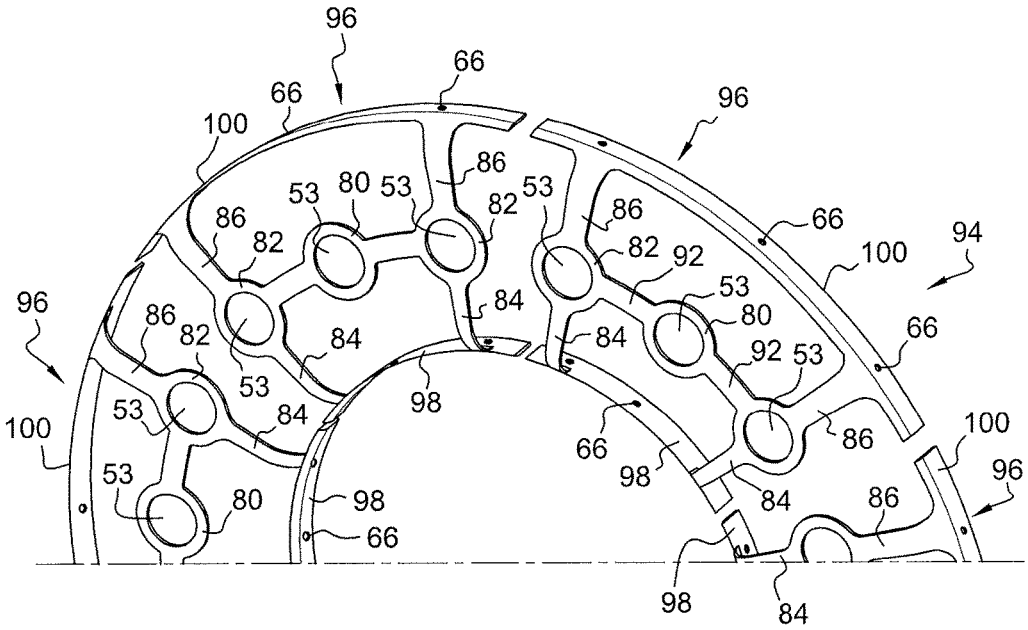
FIG. 6 is a schematic view, in perspective, of the means of axial retention in the upstream direction of the centring means of an injector according to a fourth embodiment of the invention.

FIG. 6 is a fourth embodiment of an annular crown 94 according to the invention, consisting of a circumferential repeating of several independent patterns 96 juxtaposed on the circumference, without any contact. Each pattern 96 comprises a portion of an internal cylindrical rim 98 and a portion of an external cylindrical rim 100 used for fixing each pattern 96 on the internal 12 and external 14 walls of revolution.

In other embodiments, not shown, the crown could comprise one fixing cylindrical rim on one of the internal and external walls of revolution. Although perfectly feasible, such embodiment proved less reliable than those shown in the figures because of the double internal and external fastening of the annular crown.

The invention claimed is:

1. An annular combustion chamber in a turbine engine, comprising:

two coaxial walls of revolution comprising a radially internal wall and a radially external wall;

fuel injectors disposed between the internal wall and the external wall, each fuel injector engaged in a respective centring means which are moveable in the radial direction in a support means;

means of axial retention in the upstream direction of the centring means, with said means of axial retention in the upstream direction being removably fixed on at least one of the internal wall and external wall, wherein the means of axial retention in the upstream direction comprise a radial annular crown radially fixed internally and/or externally the internal wall and/or the external wall and comprising a plurality of rings regularly spaced apart circumferentially disposed radially between the internal wall and the external wall, the plurality of rings delineating an annular row of openings, with each ring of the plurality of rings forming a passage for receiving a respective one of the fuel injectors and respective centring means, with an edge of each opening being adapted to form an axial stop in the upstream direction of a radial annular collar of the respective centring means of the respective one of the fuel injectors, wherein the annular crown comprises a pattern that successively repeats circumferentially to form the annular crown, the pattern comprising:

at least one ring of the plurality of rings of the annular crown, the at least one ring having a radially internal lug extending radially inward from the at least one ring and a radially external lug extending radially outward from the at least one ring, the radially internal lug being connected to an internal rim that extends circumferentially and in an axially downstream direction, the radially internal rim and radially internal lug configured to fix the at least one ring on the internal wall, and the radially external lug being connected to a radially external rim that extends circumferentially and in the axially downstream direction, the radially external rim and radially external lug configured to fix the at least one ring on the external wall.

2. The combustion chamber according to claim 1, wherein the at least one ring is one ring of the plurality of rings.

3. The combustion chamber according to claim 1, wherein the at least one ring is at least three rings, among which two circumferential end rings of the pattern each comprise a respective radially internal lug and radially external lug, with the rings of the pattern that are circumferentially between the two circumferential end rings of the pattern being devoid of radially internal lugs and radially external lugs and are connected to said two circumferential end rings by circumferentially extending arms.

4. The combustion chamber according to claim 1, wherein the annular crown is a single-piece part.

5. The combustion chamber according to claim 1, wherein the support means comprise means of axial retention in the downstream direction of the centring means, with said support means being fixed on a bottom annular wall of the annular combustion chamber.

6. The combustion chamber according to claim 1, wherein the means of axial retention in the upstream direction are fixed on said internal wall and external wall using a same means for fixing said internal wall and external wall to a bottom annular wall of the annular combustion chamber.

7. The combustion chamber according to claim 1, wherein the annular crown comprises a plurality of crown portions which are circumferentially juxtaposed.

8. A turbine engine comprising a combustion chamber according to claim 1.

9. The turbine engine of claim 8, further comprising a turbojet.

10. The turbine engine of claim 8, further comprising a turboprop.

11. An axial retention element for a centring means of a fuel injector in an annular combustion chamber of a turbine engine, the axial retention element comprising a radial annular crown which:

is fixed on at least one of two coaxial walls comprising an internal wall and an external wall of the annular combustion chamber, and comprises a plurality of rings regularly spaced apart circumferentially and defining an annular row of openings for the passage of fuel injectors, with an edge of each opening being adapted to form an axial stop in the upstream direction of a radial annular collar of the centring means of one of the fuel injectors, comprises a pattern that successively repeats circumferentially to form the annular crown, the pattern comprising:

at least one ring of the plurality of rings of the annular crown, the at least one ring having a radially internal lug extending radially inward from the at least one ring and a radially external lug extending radially outward from the at least one ring, the radially internal lug being connected to an internal rim that extends circumferentially and in an axially downstream direction, the radially internal rim and radially internal lug configured to fix the at least one ring on the internal wall, and the radially external lug being connected to a radially external rim that extends circumferentially and in the axially downstream direction, the radially external rim and radially external lug configured to fix the at least one ring on the external wall.

12. An annular combustion chamber in a turbine engine, comprising two coaxial walls of revolution, one an internal wall and the other an external wall, between which emerge fuel injectors each engaged in centring means which are moveable in the radial direction in support means, the chamber also comprising means of axial retention in the upstream direction of the centring means, with said means of axial retention in the upstream direction being removably fixed on at least one of the internal wall and external wall, wherein the means of axial retention in the upstream direction comprise a radial annular crown radially fixed internally or externally on at least one of the internal wall and external wall and comprising a plurality of rings regularly spaced apart circumferentially and delineating an annular row of openings for the passage of the fuel injectors, with the edge of each opening being adapted to form an axial stop in the upstream direction of a radial annular collar of the centring means of one of the fuel injectors, wherein the annular crown comprises a pattern that successively repeats circumferentially to form the annular crown, the pattern comprising:

at least one ring of the plurality of rings of the annular crown, the at least one ring having a radially internal lug extending radially inward from the at least one ring and a radially external lug extending radially outward from the at least one ring, the radially internal lug being connected to an internal rim that extends circumferentially and in an axially downstream direction, the radially internal rim and radially internal lug configured to fix the at least one ring on the internal wall, and the radially external lug being connected to a radially external rim that extends circumferentially and in the axially downstream direction, the radially external rim and radially external lug configured to fix the at least one ring on the external wall.

* * * * *